US008800610B2

(12) United States Patent
Meinzinger

(10) Patent No.: US 8,800,610 B2
(45) Date of Patent: Aug. 12, 2014

(54) FILLING DEVICE FOR FILLING CONTAINERS

(75) Inventor: Rupert Meinzinger, Kirchroth (DE)

(73) Assignee: Krones AG (DE)

( * ) Notice: Subject to any disclaimer, the term of this patent is extended or adjusted under 35 U.S.C. 154(b) by 432 days.

(21) Appl. No.: 12/833,729

(22) Filed: Jul. 9, 2010

(65) Prior Publication Data

US 2011/0005637 A1 Jan. 13, 2011

(30) Foreign Application Priority Data

Jul. 10, 2009 (DE) ..... 10 2009 032 795

(51) Int. Cl.
*B65B 3/04* (2006.01)

(52) U.S. Cl.
USPC ..... 141/105; 141/83; 141/94

(58) Field of Classification Search
USPC ..... 141/83, 94–95, 144–146, 192, 198, 141/102, 105, 104, 311 R
See application file for complete search history.

(56) References Cited

U.S. PATENT DOCUMENTS

| | | | | |
|---|---|---|---|---|
| 2,372,899 | A | 4/1945 | Kantor | |
| 5,829,476 | A | 11/1998 | Kaneko et al. | 137/606 |
| 5,865,225 | A * | 2/1999 | Weiss | 141/198 |
| 6,546,970 | B2 * | 4/2003 | Gatteschi | 141/106 |
| 6,810,927 | B2 * | 11/2004 | Ronchi | 141/146 |
| 8,020,590 | B2 * | 9/2011 | Togni | 141/104 |
| 8,096,331 | B2 * | 1/2012 | Marogna | 141/144 |
| 8,459,315 | B2 * | 6/2013 | Clusserath et al. | 141/90 |
| 8,596,307 | B2 * | 12/2013 | Krulitsch et al. | 141/9 |
| 8,631,839 | B2 * | 1/2014 | Meinzinger | 141/105 |
| 2009/0236007 | A1 | 9/2009 | Clusserath | |
| 2010/0300580 | A1 | 12/2010 | Macquet et al. | 141/83 |
| 2011/0023994 | A1 * | 2/2011 | Meinzinger | 141/1 |
| 2011/0039044 | A1 * | 2/2011 | Clusserath | 428/34.1 |
| 2011/0303325 | A1 * | 12/2011 | Gras et al. | 141/105 |

FOREIGN PATENT DOCUMENTS

| | | | |
|---|---|---|---|
| DE | 43 24 799 | 1/1995 | B67C 3/20 |
| DE | 195 43 945 | 5/1997 | B67C 3/20 |
| DE | 10 2006 045 987 | 4/2008 | B67C 3/02 |
| EP | 0 354 130 | 2/1990 | B67C 3/20 |

(Continued)

OTHER PUBLICATIONS

Translation of EP0775668, Schreiber Translations, Inc., Aug. 2012.*

(Continued)

*Primary Examiner* — Timothy L Maust
*Assistant Examiner* — Timothy P Kelly
(74) *Attorney, Agent, or Firm* — Hayes Soloway P.C.

(57) ABSTRACT

A filling device for filling containers with a liquid has a first port for supplying a first liquid to the filling device, a second port spaced from the first port for supplying a second liquid to the filling device A mixing chamber within the filling device includes a first liquid channel which guides the first liquid from the first port to the mixing chamber, and a second liquid channel which guides the second liquid from the second port to the mixing chamber, wherein the first liquid channel and the second liquid channel guide the first liquid and the second liquid separately from one another A valve body controls discharge of the liquids from the filling device through an outlet to the container. The valve body is disposed at least partially between the mixing chamber and the outlet.

20 Claims, 3 Drawing Sheets

(56) References Cited

FOREIGN PATENT DOCUMENTS

| | | | |
|---|---|---|---|
| EP | 0775668 | 5/1997 | ..... B67C 3/20 |
| EP | 1 362 825 | 2/2006 | ..... B67C 3/20 |
| FR | 2925022 | 6/2009 | ..... B65B 3/32 |
| WO | WO2009129937 | 10/2009 | ..... B67C 3/26 |

OTHER PUBLICATIONS

Chinese Office Action issued in Application No. 2010102311365 dated Aug. 5, 2011 (7 pgs).

Chinese Office Action issued in corresponding application No. 2010102311365, dated May 4, 2012 (4 pgs).

German Search Report, dated Jul. 10, 2009.

* cited by examiner

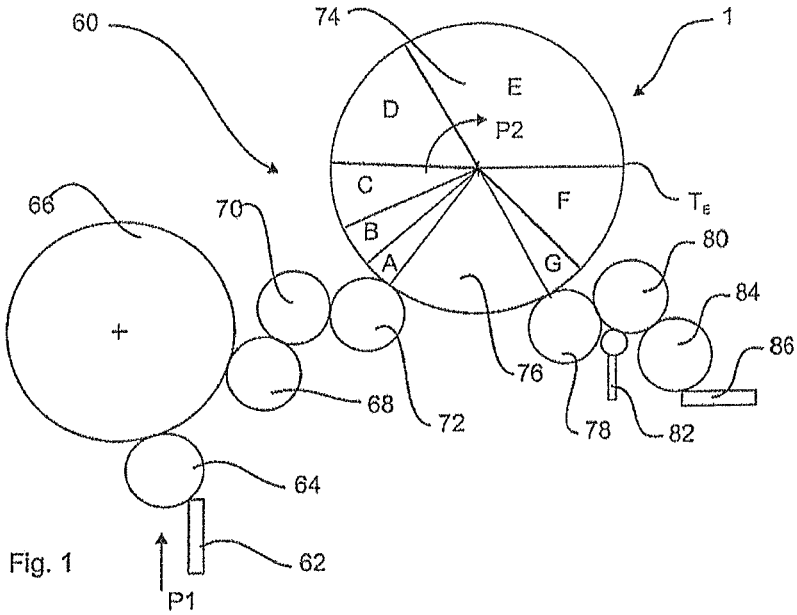
Fig. 1
Fig. 2
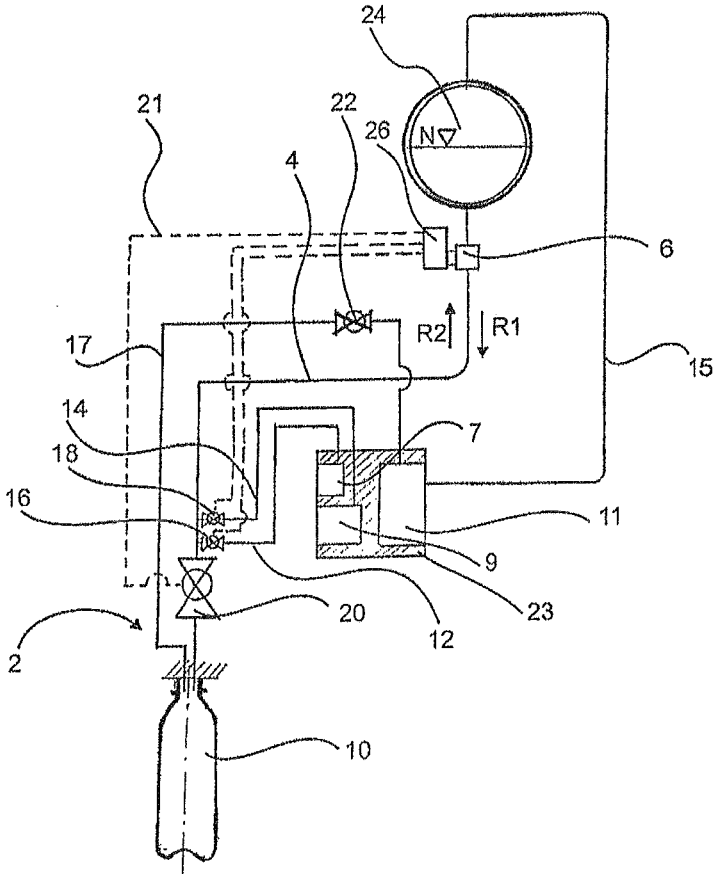

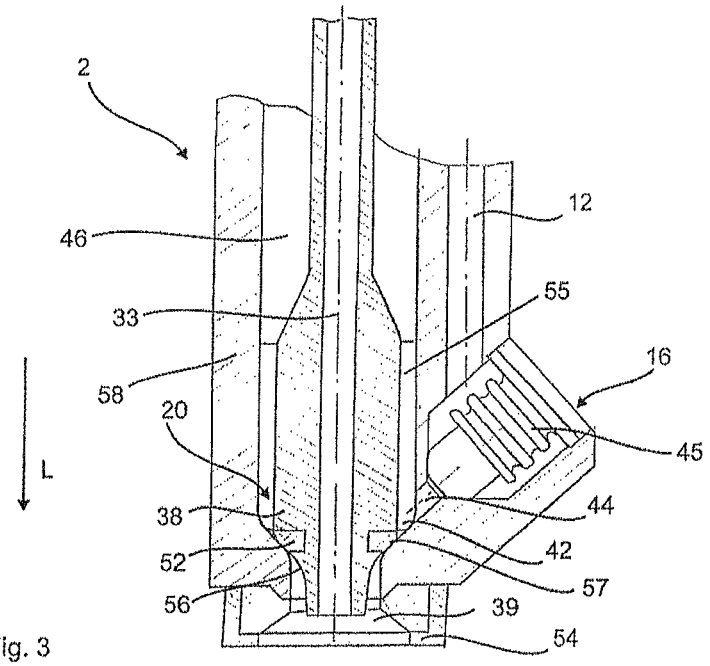
Fig. 3
Fig. 4
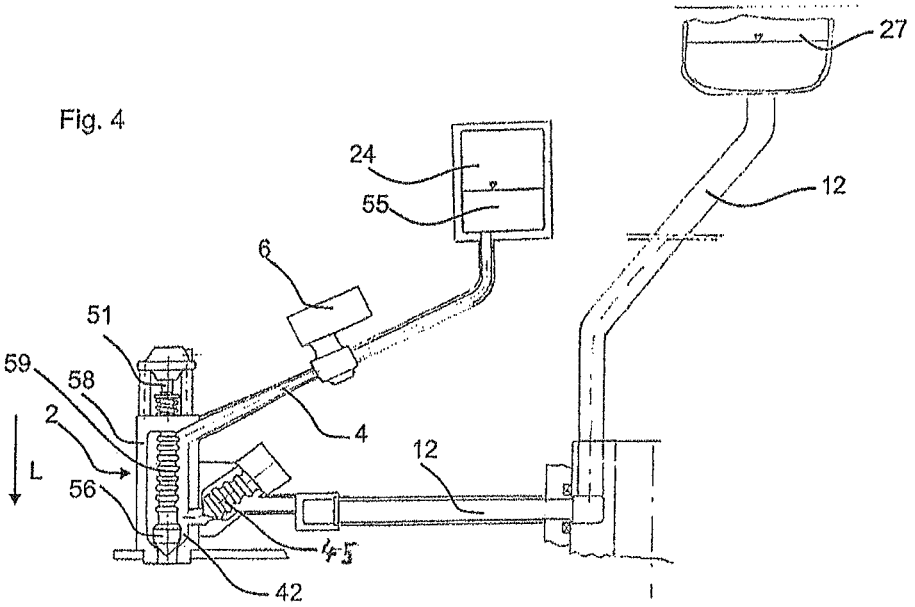

FILLING DEVICE FOR FILLING CONTAINERS

BACKGROUND OF THE INVENTION

The present invention relates to a filling device for filling containers and in particular for filling containers with multi-component beverages. Such filling devices are known from the prior art and are used, for example, for bottling still and carbonated beverages, to which syrups or liquids containing fibres or solids are added. It is to be noted, however, that the filling device described may also be suitable for bottling other liquids such as, for example, oils, milk, juices, liquid refreshments.

In the case of such filling devices, usually several components of the substance to be bottled are added and these are filled into the container to be filled via a filling valve. In particular, if one of the components is a component including fruit pieces or the like, then this may sometimes be difficult to realise, since the respective valves may cause these liquids to splash about.

The present invention is therefore based on the object of providing a filling device for filling liquids, in particular beverages, into containers, which improves the filling process and in particular also the filling in of liquids containing pieces of fruit or the like.

From DE 10 2006 045 987 A1, a method for filling containers with a liquid product as well as a filling system are known. Here, at least two components of the product are mixed together. At least one of the components is supplied here using a flow meter in a manner in which both the filling quantity and the volume are controlled.

EP 1 362 825 B9 describes a rotary machine for filling containers. Here, a supply device for additives includes several pipes, with means for blocking the opening of the pipes being arranged along the pipes, in order to open and close the latter.

U.S. Pat. No. 5,829,476 describes a filling valve for two filling streams. Here, a flow channel is disposed within the second flow channel and this internal flow channel includes a valve which is movable relative to this flow channel, so that the supply of a second liquid to a first liquid may be controlled. Due to this arrangement of the valve, however, an inadequate mixing of the two liquids to be mixed may occur, and the obstruction of the outlet of the mixed liquid from the filling device is connected with problems, if said second liquid contains pieces of fruit or the like.

SUMMARY OF THE INVENTION

A filling device according to the invention for filling containers with a liquid and in particular a beverage includes a first port for feeding a first liquid into the filling device, as well as a second port for feeding a second liquid to the filling device, wherein the first port and the second port are separate from each other and are preferably also spaced from one another.

Further, a kind of mixing chamber is formed within the filling device, in which the liquids are brought into contact with each other in order to be mixed, as well as a first liquid channel which guides the first liquid from the first port to the mixing chamber, and a second mixing channel which guides the second liquid from the second port to the mixing chamber, wherein the first liquid channel and the second liquid channel guide the first liquid and the second liquid separately from one another.

Further, a valve body for controlling an outflow of the liquids from the filling device and a discharge for discharging the liquid to the container are provided.

According to the invention, the valve body is disposed at least partially and preferably completely between the mixing chamber and the discharge.

In the case of the above-mentioned U.S. Pat. No. 5,829,476 a valve is provided, which terminates one of the two liquid channels. When this channel is opened, one liquid is brought together with the other liquid. However, downstream thereof no further valve for metering the liquid already mixed into the container is provided.

Thus, according to the present invention it is suggested to bring the components together as early as upstream of the valve and then to pass them through a common valve into the container. Apart from the above-mentioned valve body, advantageously no further valve is provided between the discharge and the two said liquid channels, so that said valve body is the only valve means between the two liquid channels and the discharge and is preferably also the only valve body between the two ports and the discharge.

In one advantageous embodiment, the filling device includes an actuation element for actuating the valve body, and this actuation element extends at least partially within the second liquid channel. Advantageously, this actuation element extends geometrically also within the first liquid channel.

Thus, the two liquids are initially guided into the mixing chamber in an unmixed state. This actuation element is advantageously connected to the valve body in such a way that an actuation of the actuation element will also cause a corresponding movement of the valve body, in particular in the longitudinal direction of the filling device. Preferably, the apparatus includes a return element which pushes the actuation element and thus also the valve body into a closed position of the valve. As a result, said valve body is also a component of a valve which controls the discharge of the filling device.

In a further advantageous embodiment, the filling device includes a further channel for guiding a gaseous medium. This channel may for example be a return channel in order to carry off a gaseous medium, e.g. carbon dioxide, out of the container during the filling process, i.e. the so-called return gas.

In a further advantageous embodiment, the first liquid channel surrounds the second liquid channel at least in sections. Preferably, the second liquid channel completely surrounds the first liquid channel at least in an area of the longitudinal direction in the circumferential direction. Thus, for example, the second liquid channel may be annularly formed around the first liquid channel.

In a further advantageous embodiment, the two liquid channels lying inside each other are rigid, i.e. stationary relative to one another and relative to the housing of the filling valve.

In a further preferred embodiment, the second liquid channel is used for transporting a liquid that contains particles. This liquid may, for example, be a pulp, i.e. a liquid which also contains flesh or pieces of fruit.

In a further advantageous embodiment, the second port is located closer to the mixing chamber than the first port. Advantageously, the second port is used for supplying the pulp. Conversely, however, it would also be possible for the second port to be used for supplying a clear liquid, such as for example also a carbonated liquid.

In a further advantageous embodiment, at least one liquid channel and preferably the first liquid channel extends at an angle at least in sections. As a result of this oblique extension, an optimised flow profile may be achieved in both liquids up to the outlet from the discharge opening. Preferably, the first and the second liquid channels are formed parallel to one another and in particular concentrically to one another in sections.

In a further advantageous embodiment, the first liquid channel and the second liquid channel are arranged in a common housing.

Advantageously, the valve body is adjacent to the mixing chamber. This means that, for example, during a filling process, the two liquids are initially mixed together in the mixing chamber and subsequently the mixture is discharged from the filling device by opening the valve body. In this way, also any splashing that might be caused by pieces of fruit may be prevented.

It would, however, also be possible to specifically control the supply of the first liquid, i.e. in particular the clear liquid, during the filling process in such a way that initially the first liquid, then the mixture flows into the container and subsequently a certain amount of clear liquid is added, so that any remaining pieces of fruit will be removed from the valve body.

In a further advantageous embodiment, a bellow for sealing the actuation element is provided on the inside of the first liquid channel. Since this actuation element—as was explained above—is advantageously guided within the liquid channel, a sealing off of the actuation element against the liquid surrounding it may be achieved by said bellow. This bellow allows a movement of the actuation element and prevents at the same time that the actuation element comes into contact with the liquid.

In a further advantageous embodiment, a centring element, which is movable relative to the first liquid channel, for centring a position of the valve body is provided inside the second liquid channel. This centring element is thus guided by the liquid channel or the internal wall thereof, so that the valve body may be moved at all times to an exact position relative to the filling device in its longitudinal direction. In this way, a proper closing of the valve of the filling device is made possible.

In a further advantageous embodiment, the first liquid channel is shorter than the second liquid channel in a longitudinal direction of the filling device. Particularly preferably here the outer channel is also shorter than the inner channel and is shorter than the inner channel particularly towards the top, i.e. away from the container. Advantageously, therefore, the port which leads to the outer or second channel is at a lower level than the port leading to the inner channel or the first channel. As mentioned above, the first channel is advantageously used for filling in a main product and the second channel for filling in the second liquid, which may in particular be a pulp. Here, no complex feed-through of a product line through the wall of an outer channel into an inner channel is necessary, so that the construction may be simple in design, cost effective in manufacturing and have low maintenance requirements.

Advantageously, the filling device has two liquid lines separate from each other, which guide the liquids to said ports of the filling device. Advantageously here at least one of the two liquid lines is formed at an angle, and also their opening cross section advantageously expands in the direction of the filling device in at least one area.

In a further advantageous embodiment, in at least one of the liquid lines and preferably in exactly one of the liquid lines, a flow measuring device is provided, which determines the quantity of liquid passing through the flow measuring device in two flow directions which are opposite to one another. Therefore, contrary to the prior art, it is suggested that the flow measuring devices can also determine the flow rate in both flow directions. In this way, the system may be able to work with just one flow measuring device, since for example when feeding in the second liquid, the first liquid will be pushed back by a certain volume and the flow measuring device can detect this displacement, in order to determine in this way the quantity of liquid supplied.

In a further advantageous embodiment, at least one liquid line is formed in such a way that in a working operation and independently from the flow direction, only one of the liquids passes through the flow measuring device. In this way it is ensured that only one liquid, and in particular the clear liquid, will flow through the flow measuring device, but not the second liquid, which—as was mentioned above—may be a pulp. Thus, the corresponding liquid line is preferably formed with regard to its volume in such a way that the second liquid filled in can under no circumstances get as far back as the flow measuring device.

BRIEF DESCRIPTION OF THE DRAWINGS

Further advantages and embodiments will become evident from the attached drawings, wherein:

FIG. 1 shows a schematic view of a system for filling beverage containers;

FIG. 2 shows a view in the form of a block diagram of an aspect of the present invention;

FIG. 3 shows a sectional view of a filling device;

FIG. 4 shows a schematic sectional view of a filling device according to the invention;

FIG. 1 shows a schematic view of a system 60 for filling containers. This system 60 includes a container supply 62 which supplies containers along the arrow 21 via an in-feed star wheel 64 of a rinsing device 66 or a rinser.

DETAILED DESCRIPTION OF THE INVENTION

Figure 5:
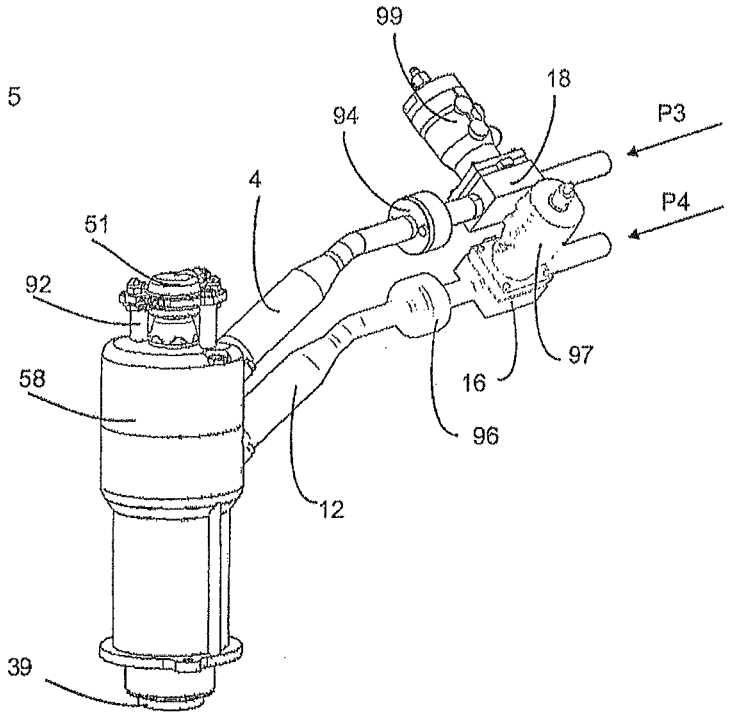
FIG. 5 shows a perspective view of a filling device.

Reference numeral 68 relates to an out-feed star wheel of the rinsing device 66 which takes over the rinsed containers and passes them on via a transfer star wheel 70 and a filler inflow star wheel 72 to an apparatus 1 for bottling beverages. In this apparatus 1, two-component beverages are bottled. Reference letters A to G identify different method steps carried out when bottling the beverages. Thus, in a step A, the container is pressed against a filling device, and in a step B, the container is preloaded or a gaseous medium such as for example carbon dioxide is applied to it. In a step C, an initial amount of a clear main product is filled into the container, such as for example a carbonated beverage. In a step D, a secondary product may be supplied or a secondary product plug may be filled into the main, product. In zone E, a post-filling of the main product takes place. Reference letter $T_E$ identifies the end of the filling process of the beverage into the container.

In a step F, the bottled beverage may be allowed to settle or to relax, and in a step G, the container is removed from the filling device.

Reference numeral 78 relates to an out-feed star wheel of apparatus 1 and reference numeral 80 relates to a closing device, in order to close the containers with closures, and reference numeral 82 relates to a supply device for the container closures. Reference numeral 84 identifies an out-feed star wheel of the closing means and reference numeral 86 relates to a take-off device for transporting off the filled containers.

Reference numeral 76 identifies a dead angle in which no containers are filled or in which no containers are present in corresponding filling stations. In this dead angle between the filler out-feed star wheel and the filler in-feed star wheel, a metered amount of an additive product may be added to the main product. Thus, this angle is also used for the filling process and in this way the overall performance of the filler may be enhanced, since the metering process does not always have to be carried out in the angular range (A to G) that is usually available. This metering process will be described in more detail with reference to the further figures. From the point of view of the method it is therefore suggested to add the metered quantity of further liquid to the first liquid with a time delay after the filling of the container.

Thus, the apparatus shown in FIG. 1 is also used for mixing beverages from at least two or more different liquids. These liquids may for example be water, syrup and/or flavouring agents in a predetermined mixing ratio relative to the container volume to be filled. Here, too, the various liquids are advantageously mixed together within the space that follows the point of distribution to the individual filling valves. Within the context of an aspect of the invention it is suggested to carry out the bringing together of the different media so closely as possible to the filling valve outlet, that the medium added will advantageously be automatically discharged during the subsequent container filling process. By means of this approach, each subsequent filling may be varied by supplying several different flavouring agents. Besides, in this way critical product such as for example pulp may be flushed away from the valve device or the valve cone.

FIG. 2 shows a view in the form of a block diagram of an apparatus 1 according to the invention. Here, reference numeral 24 relates to a reservoir for the main product. From this reservoir 24, the product will flow to the filling device 2 which is generally identified here with the reference numeral 2 and is not shown in more detail, via a first liquid line 4. Reference numeral 6 relates to a flow measuring device adapted to measure the liquid flow in the direction R1. Preferably, the flow measuring device 6 is an inductive flow meter.

Reference numeral 20 identifies a filling valve for controlling the filling of liquid into the container 10.

Here, a secondary product such as syrup may be supplied to the liquid line 4 or the filling device 2 via a second liquid line 12 fed from an annular channel 7.

During the filling process, the valve 20 may be closed and subsequently the valve 16 for supplying the secondary liquid may be opened. This in turn causes the main liquid to be pushed back in the liquid line 4 and thus to flow into the area of the flow meter in the flow direction R2.

Since the flow measuring device 6 is also suitable for determining the flow in the direction R2, it is possible to determine on the basis of these measurements how much liquid was supplied via the line 12. However, here the length of this liquid line 4 is preferably dimensioned such that the product present in the line 12 will not itself be pushed through the flow measuring device 6.

Reference numeral 26 relates to a control device that receives the measurement signals of the flow measuring device 6 and drives for example the valve 16, but also the valve 20. In this way, an automated filling of the container may be achieved. The control device may also be installed at a remote location and in this case the measurement signals from the flow metering device are transferred to the control device and the remote control device will then drive the valves.

As has already been mentioned, when adding metered products via the liquid line 12, for example product pieces, these must not be pushed through the flow measuring device 6, because this would affect the accuracy of the measurement. Therefore, the volume of the product line between the flow meter and the actual metering point will have to be dimensioned correspondingly, so that only the main product is pushed back through the flow measuring device 6.

It is also possible here for the second liquid line (secondary product line 12) to be further away from the valve outlet of the filling device 2 into the main product line in the direction of the flow metering device 6 or to form the first liquid line 4. In this way, an initial amount of clear liquid may be filled in, i.e. the secondary product is filled in as a plug between two parts of the main product. In this case, however, it is advantageously taken into account that the subsequent part of the main product is large enough to flush the secondary product, i.e. the second liquid, completely out of the valves.

This initial filling in of a clear liquid has the advantage that when adding metered amounts of fruit cells or fruit pieces immediately during the opening of the valve or the valve cone thereof, a perfect filling jet is generated. If fruit cells are present on the valve cone during opening, then these may interfere with the immediate formation of the filling jet, which could cause an uncontrolled splashing about of product.

FIG. 2 shows a radial supply of the secondary product via the line 12. However, it would also be possible for this metered adding of secondary product to take place in other directions, for example tangentially or in a different way obliquely into the first line 4. In this way, the thorough mixing of main and secondary products in the main line 4 may be improved, as a result of which flushing out of the secondary product will be simplified.

Reference numeral 14 relates to a third liquid line, which may be used to supply a further liquid for example via an annular channel 9. Here, too, a valve 18 is provided which controls the supply of this product into the filling device 2 or the valve 20.

Reference numeral 11 relates to a channel for a gaseous medium such as for example carbon dioxide. This channel 11 is in contact with the reservoir 24 via a connection line 15, in order to form a gaseous phase in this reservoir or to apply a load on the main product, the filling level of which is identified here with the reference letter N. A further connection line 17 connects the channel 11 with the container. This channel 17 is a return gas channel which feeds $CO_2$ back into the channel 11 during the filling process of the containers. Reference numeral 22 relates to a valve which is used here as a return gas valve and a pre-charge valve.

Reference numeral 21 identifies (electrical) control lines which are in communication with the individual valves 20, 16 and 18 via the control unit 26.

The secondary medium, which is supplied via the liquid line 12, is preferably fed in at a higher pressure than the product in the first liquid line 4. In this way, on the one hand a pushing back of the product in the liquid line 4 may be achieved, and on the other hand it is possible to bring together in this way two liquids interspersed with gas. A pressure higher than that for the liquid in the first liquid line 4 may also be used for the liquids in the third liquid line 14.

The dosage area or the dosage position may be implemented in any nozzle form or as a diffuser depending on the product, as a result of which the thorough mixing upon dosing will be improved. It would also be possible to add the syrup or the additional product in a metered way under $CO_2$ pressure during counter-pressure filling or to add the syrup in a condition in which it is already slightly "carbonated". In this way, any possible $CO_2$ dissociation caused by turbulences in the mixing area may be counteracted.

The return gas channel 17 could also be used as a CIP (cleaning in place) return channel. It would also be possible here to provide a branch going off from this channel into a CIP return path, for example downstream of the valve block using return gas and/or pre-charge valves.

In particular, in more complex filling processes, the valve block (not shown) includes several gas valves for various functions, via which the return gas channel will then be divided up into several gas channels in the channel carrier 23.

It would further be possible, in the case of an implementation with several dosage points on a filling valve, to use the filling device also for "multicoloured filling", wherein different products are filled in from one filling valve to another, or a filling process depending on commissions is carried out or the various products are filled one after the other within the same production shift, where a very quick changeover from one product to another may be carried out. In order to control this filling process known from the prior art, the apparatus according to the invention—which may be used in the same way as for the filling process according to the invention—includes a filler control device (not shown), such as an SPS.

FIG. 3 shows a filling device 2 according to one aspect of the invention. This filling device or this filling valve includes a valve means 20 which in turn has a valve body or a valve plunger 38. Reference numeral 12 relates to the second liquid line for supplying the secondary product. This secondary product will be fed via a valve 16 through a connection line 44 into a mixing chamber 42. Reference numeral 39 identifies the outlet of the valve 20, from which liquid is fed into the containers. Reference numeral 54 identifies a housing of the filling device. Return gas such as for example $CO_2$ may be carried off again via a return gas channel 33. The valve body 38 may be moved in the longitudinal direction L thereof and may control in this way the supply of product to the outlet 39 and thus into the container.

To this end, the valve has a sealing washer 52 which in the closed state of the valve pushes against a housing section 57 and thus closes the valve. Reference numeral 56 identifies the corresponding valve cone.

Reference numeral 46 identifies a supply channel for supplying the main product within the filling device. It can be seen that the channel 46 is either close or immediately adjacent to the valve area. Reference numeral 55 identifies the product to be filled in.

The filling device 2 shown in FIG. 3 is particularly useful for mixing and bottling carbonated liquids mixed with syrup, in particular in combination with fruit fibres and pieces. It is already known from the prior art to feed two liquids from two separate containers into a common mixing chamber. Usually a filling system is used here for filling in liquids having a proportion of fibres or solids, which is sealed immediately before the outlet of the filling valve. In the case of this special outlet geometry, no product will be present upon sealing at the end of the filling process, so that a gas barrier may be dispensed with. A gas barrier is a component which prevents, by utilising the surface tension, liquids from escaping from a line that is open on one side. Such gas barriers, however, are not suitable for larger proportions of fruit fibres.

However, this proven system for retaining and switching off is resorted to also within the context of the invention. However, an improved or flow-optimised feeding to the filling valve outlet 39 is provided which, as was mentioned above, is sealed off by means of the cone 56. For any further medium to be added, for example via the line 44, a further feeding line leads to the common mixing chamber 42 which is designed in such a way that the mixing of the various media from one filling to another may be reproduced.

In order to ensure the desired sequence of the filling process, each feeding line includes a shut-off mechanism, such as the valve 16 here. The various dosing quantities of the media supplied may be measured with known measuring means, such as for example by means of a load cell on which the container to be filled is placed, or by means of a flow measuring device (not shown). Preferably, this measuring device is a load cell, so that a measuring instrument for any medium will be provided.

Advantageously, a dosage of one, several or all of the media is further provided via a certain volume stream and flow duration. A prerequisite for this is that the liquids are brought together at a location as closely as possible to the outlet 34 and have an appropriate constitution.

FIG. 4 shows a further view of an apparatus according to the invention, which is particularly suitable for bottling liquids including a secondary product containing fruit pieces or fibres. Apart from the actual filling device 2, also the environment thereof can be seen here, i.e. in particular the first supply line 4 and the second supply line 12 for the secondary product. This second supply line 12 is fed from a reservoir 27, which is positioned here at a higher level than the reservoir 24, so that the liquid reaches the filling device 2 under a higher pressure than the liquid in the liquid line 4. Reference numeral 51 relates to an actuating device for actuating the valve body 56 in the longitudinal direction 11, such as for example a pneumatic drive. Reference numeral 58 in turn identifies the housing of the filling device 2. Reference numeral 45 relates to a bellow which is a component of the valve 16, so that the valve area, too, may be surrounded by the liquid. A corresponding bellow 59 is also provided in the filling device 2 and may therefore be surrounded by the main product coming from the feed line 4.

During the filling process, initially the first medium to be filled in, for example the main product, is filled in by opening the corresponding valve into the media supply and closing the other ones. Subsequently, or at the same time, the outlet of the filling valve is opened or the valve 20 is opened. Once the desired partial amount is reached, the filling valve outlet 34 is closed again. However, media may also be changed over with the valve 20 opened (cp. FIG. 2) if this is carried out without any overlap. As was mentioned above, the subsequent medium will displace the preceding medium, so that a reproducible mixing ratio is achieved.

Preferably, each feed line includes a separate shut-off mechanism or valve for the liquid here.

FIG. 5 shows a further view of a filling device 2 according to the invention as well as the environment thereof. Here, reference numeral 58 again relates to a housing and reference numeral 51 relates to a valve drive for driving the valve which is mounted on the housing 58 by fastening means 92. Reference numeral 39 again identifies the valve outlet. Here, shutters or throttles 94, 96 are disposed in the two product lines 4 and 12. The products will be supplied as shown by the arrows P3 and P4. Reference numerals 16, 18 each relate to a diaphragm valve actuated by a drive 97, 99, respectively.

Figure 6:
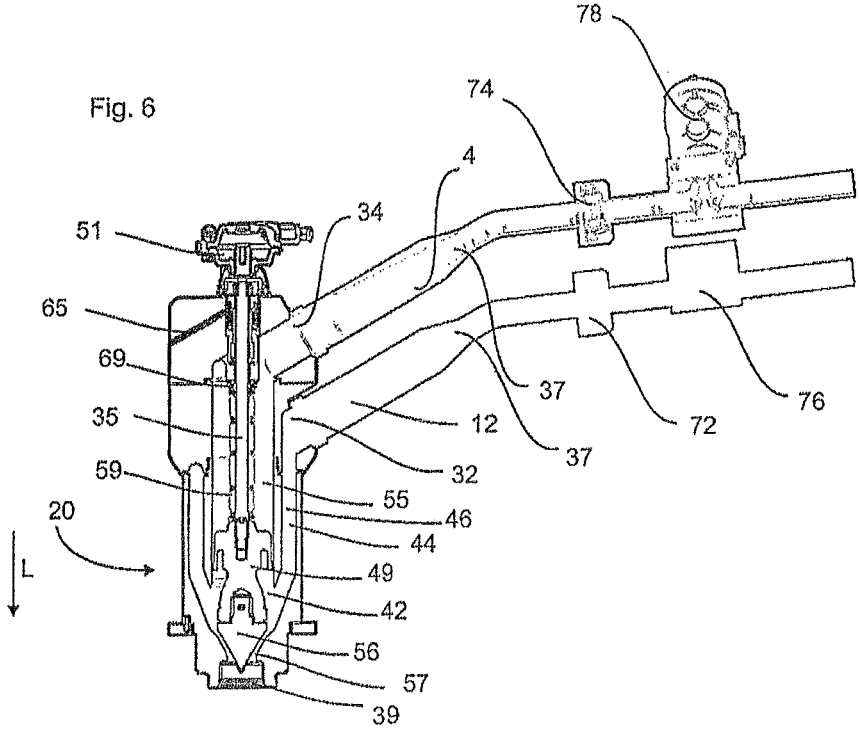
FIG. 6 shows a schematic sectional view of the filling device shown in FIG. 5.

FIG. 6 shows a sectional view of the filling device shown in FIG. 5. What can be seen here again is a valve cone 56 which may be moved in the direction L and which may rest against a valve seat 57. The main product is supplied along the first feed line 4 via a supply channel 55 into a mixing chamber 42.

In this mixing chamber 42, the main product may be mixed with a secondary product (preferably with the valve 20 closed) coming from the product line 12. Here, the channel 44 for the secondary product completely surrounds the channel 55 for the main product in the circumferential direction.

Reference numeral 59 again identifies the bellow which allows the formation of the channel 55 for the main product. Within this bellow, an actuation rod for actuating the valve is guided. Reference numeral 49 relates to a centring device for the valve cone 56. It can be seen here that the second port 32 for the secondary product (or the second liquid) is disposed at a lower level than the first port 34 for the main product (or the first liquid). Further, the channel 44 is adjacent to the valve cone 56, so that it may always be ensured that the container is filled with the main product at the beginning and is again filled with the main product towards the end.

Reference numeral 65 identifies a ventilation bore and reference numeral 69 identifies a return spring, in order to move the valve cone 56 into its closed position in the unconnected state. Thus, in the embodiment shown in FIG. 6, channel 44 is annularly shaped and surrounds the channel 55, as was mentioned above. Both feed lines 4 and 12 have an expansion area 37 each which are used for a flow-optimised supply of the two products.

By means of the arrangement shown in FIG. 6, any crossovers of the channels 44 and 55 may be avoided, or the two product channels lie inside of each other. The mixing chamber 42 is here located in the immediate vicinity of the valve body 56, and preferably also the feed lines or the two ports 32 and 34 are each provided above this mixing area 42.

The two product channels (44, 55) shown in FIG. 6, which lie inside of each other, are rigid and stationary in relation to one another as well as in relation to the housing 58. The only movable components within the filling device are the components of the valve outlet closure.

All of the features disclosed in the application documents are claimed as being essential to the invention, in as far as they are novel over the prior art either individually or in combination.

LIST OF REFERENCE NUMERALS

1 Apparatus
2 Filling device
4 First liquid line
6 Flow measuring device
7, 9 Annular channel
10 Container
11 Channel
12 Second liquid line
14 Third liquid line
15, 17 Connection line
16, 18 Valve
20 Filling valve
21 Control line
22 Valve
23 Channel carrier
24, 27 Reservoir
26 Control device
32 First port
33 Return gas channel
34 Second Port
35 Actuation element
37 Expansion areas
38 Valve plunger
39 Outlet of the Valve
42 Mixing chamber
44 Connection line
45, 59 Bellow
46 Supply channel
49 Centring device
51 Valve drive
52 Sealing washer
54 Housing
55 Liquid
56 Valve cone
57 Housing section, valve seat
58 Housing
59 Bellow
60 System
62 Container supply
64 In-feed star wheel
65 Ventilation bore
66 Flushing device
68 Out-feed star wheel
69 Return spring
70 Transfer star wheel
72 Filler in-feed star wheel
76 Dead angle
78 Out-feed star wheel
80 Closure device
82 Supply device for container closures
84 Out-feed star wheel
86 Take-off device
92 Fastening device
94, 96 Throttle
97, 99 Drive
A-G Method steps
L Longitudinal direction
N Filling level
P1 Arrow
R1, R2 Flow direction

The invention claimed is:

1. A filling device for filling containers with a liquid, said filling device comprising a first port for supplying a first liquid to the filling device, and a second port spaced from the first port for supplying a second liquid to the filling device, a mixing chamber formed within the filling device, in which the liquids may be mixed, including a first liquid channel for guiding the first liquid from the first port to the mixing chamber, and a second liquid channel for guiding the second liquid from the second port to the mixing chamber, wherein the first liquid channel and the second liquid channel are arranged in a common housing stationary relative to the housing and to one another, with the first liquid channel surrounding the second liquid channel at least in sections, and wherein the first liquid channel and the second liquid channel guide the first liquid and the second liquid separately from one another, and, a valve body for controlling discharge of liquids from the filling device, said valve body having an outlet for discharging the liquids to the container, wherein the valve body is disposed at least partially between the mixing chamber and the outlet.

2. The filling device as claimed in claim 1, wherein the filling device includes an actuation element for actuation of the valve, said actuation element extending at least partially within the second liquid channel.

3. The filling device as claimed in claim 1, wherein the filling device includes a further channel for guiding a gaseous medium.

4. The filling device according to claim 1, wherein the first liquid channel is used for transporting a liquid containing particles.

5. The filling device as claimed in claim 1, wherein the second liquid channel is used for transporting a liquid containing particles.

6. The filling device as claimed in claim 1, wherein the first port is disposed closer to the mixing chamber than the second port.

7. The filling device as claimed in claim 1, wherein the first liquid channel extends at an angle in sections.

8. The filling device as claimed in claim 1, wherein the mixing chamber is adjacent to the valve body.

9. The filling device as claimed in claim 2, wherein a bellows for sealing the actuation element is provided in the second liquid channel.

10. The filling device as claimed in claim 2, wherein on the inside of the second liquid channel, a centring element movable relative to the second liquid channel is provided for centring the position of the valve body.

11. The filling device as claimed in claim 1, wherein the first liquid channel is shorter than the second liquid channel in a longitudinal direction of the filling device.

12. The filling device as claimed in claim 1, wherein the filling device includes first and second liquid lines separated from one another, for guiding the liquids to the ports.

13. The filling device as claimed in claim 12, wherein a flow measuring device is disposed in first and/or second liquid lines for determining a quantity of liquid passing through the flow measuring device in two flow directions opposite to one another.

14. The filling device as claimed in claim 13, wherein the first and the second liquid lines are in a working operation independent from the flow direction, whereupon only one of the liquids passes through the flow measuring device.

15. The filling device as claimed in claim 1, wherein the first liquid channel completely surrounds the second liquid channel.

16. The filling device as claimed in claim 1, wherein the first liquid channel is annularly formed round the second liquid channel.

17. The filling device as claimed in claim 1, wherein the mixing chamber is located in an immediate vicinity of the valve body, and also the first and second liquid channel or the first and second port are each provided above the mixing chamber.

18. The filling device as claimed in claim 10, wherein the centering element is guided by an internal wall of the first liquid channel.

19. The filling device as claimed in claim 1, wherein the second liquid is fed via a valve through the second liquid channel into the mixing chamber.

20. The filling device as claimed in claim 1, wherein the filling device comprises a load cell which measures various dosing quantities of the supplied media.

* * * * *

UNITED STATES PATENT AND TRADEMARK OFFICE

CERTIFICATE OF CORRECTION

PATENT NO. : 8,800,610 B2
APPLICATION NO. : 12/833729
DATED : August 12, 2014
INVENTOR(S) : Meinzinger It is certified that error appears in the above-identified patent and that said Letters Patent is hereby corrected as shown below:

Title page, Col. 2, item (57), ABSTRACT, line 4, "device A mixing" should be --device. A mixing--.

Title page, Col. 2, item (57), ABSTRACT, line 10, "another A valve" should be --another. A valve--.

In the Claims

Claim 10, Col. 11, line 18, "centring" should be --centering--.

Claim 10, Col. 11, line 20, "centring" should be --centering--.

Signed and Sealed this
Sixth Day of January, 2015

Michelle K. Lee

Michelle K. Lee
*Deputy Director of the United States Patent and Trademark Office*